US007569515B2

(12) United States Patent
Takayama et al.

(10) Patent No.: US 7,569,515 B2
(45) **Date of Patent: *Aug. 4, 2009**

(54) ERASABLE IMAGE FORMING MATERIAL

(75) Inventors: Satoshi Takayama, Kawasaki (JP); Kenji Sano, Tokyo (JP); Takeshi Gotanda, Yokohama (JP); Yumiko Sekiguchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/032,192

(22) Filed: Feb. 15, 2008

(65) Prior Publication Data

US 2008/0138737 A1 Jun. 12, 2008

Related U.S. Application Data

(63) Continuation of application No. 11/532,738, filed on Sep. 18, 2006, now Pat. No. 7,354,885.

(30) Foreign Application Priority Data

Sep. 29, 2005 (JP) ..... 2005-284063

(51) Int. Cl.
*B41M 5/337* (2006.01)
*B41M 3/12* (2006.01)

(52) U.S. Cl. ..... 503/201; 106/31.16; 106/31.22; 106/31.23; 427/150; 503/214; 503/217; 503/220; 503/221

(58) Field of Classification Search ..... None
See application file for complete search history.

(56) References Cited

U.S. PATENT DOCUMENTS

| | | | |
|---|---|---|---|
| 5,922,115 | A | 7/1999 | Sano et al. |
| 6,203,603 | B1 | 3/2001 | Takayama et al. |
| 6,248,692 | B1 | 6/2001 | Sano et al. |
| 6,313,066 | B1 | 11/2001 | Takayama |
| 6,326,332 | B1 | 12/2001 | Takayama |
| 6,329,317 | B1 | 12/2001 | Takayama et al. |
| 2002/0009212 | A1 | 1/2002 | Urano et al. |
| 2005/0159311 | A1 | 7/2005 | Sano et al. |
| 2005/0191082 | A1 | 9/2005 | Takayama et al. |
| 2006/0111237 | A1 | 5/2006 | Takayama et al. |

FOREIGN PATENT DOCUMENTS

| | | |
|---|---|---|
| JP | 6-27739 | 2/1994 |
| JP | 2000-284520 | 10/2000 |
| JP | 2003-255595 | 9/2003 |

*Primary Examiner*—Bruce H Hess
(74) *Attorney, Agent, or Firm*—Oblon, Spivak, McClelland, Maier & Neustadt, P.C.

(57) ABSTRACT

An erasable image forming material includes a color former containing crystal violet lactone, a developer, a first binder resin of styrene-butadiene copolymer and a second binder resin of a styrene-based resin containing α-methylstyrene, the first and second binder resins being in a compatible state.

14 Claims, 2 Drawing Sheets

ERASABLE IMAGE FORMING MATERIAL

CROSS-REFERENCE TO RELATED APPLICATIONS

This application is a continuation of allowed U.S. patent application Ser. No. 11/532,738, filed on Sep. 18, 2006 now U.S. Pat. No. 7,354,885, which claims priority to Japanese Patent Application No. 2005-284063 filed on Sept. 29, 2005, the entire contents of which are incorporated herein by reference.

BACKGROUND OF THE INVENTION

1. Field of the Invention

The present invention relates to an erasable image forming material.

2. Description of the Related Art

Forest conservation is an essential requirement to maintain the terrestrial environment and suppress the greenhouse effect caused by $CO_2$. In order to minimize additional tree trimming and to keep balance with forest regeneration including tree planting, it is important how to utilize the existing paper resources efficiently.

Currently, paper resources are "recycled" by recovering paper fibers from used paper through a deinking step of removing image forming materials printed on the used paper, remaking paper fibers to manufacture recycled paper with low paper quality, and using the recycled paper according to the purpose. Thus, problems of a high cost of the deinking step and possibility of new environmental pollution by waste fluid treatment are pointed out.

On the other hand, "reuse" of a hard copy has been put into practice through erasure of images, for example, by using an eraser for pencil images and a correcting fluid for ink images. Here, the concept of "reuse" in which a paper sheet is repeatedly used for the same purpose while preventing degradation of paper quality as much as possible is different from the concept of "recycling" in which a paper sheet with degraded quality is used for other purposes. Now, the "reuse" can be said to be more important concept from a viewpoint of conservation of paper resources. If effective "reuse" at each "recycling" stage is performed, additional waste of paper resources can be minimized. Recently, for example, a rewritable paper has been proposed, which is a special paper intended to reuse hard copy paper. Use of the rewritable paper technology enables the paper to be "reused" 100 times or more if paper damage such as a wrinkle and fold due to use can be ignored, which greatly enhances the efficient use of paper resources.

However, the rewritable paper is a special paper which can be "reused" but cannot be "recycled". The rewritable paper is also defective in that recording techniques other than thermal recording cannot be applied to.

The present inventors have paid their attention to a phenomenon caused by a system of a color former and a developer that a colored state is realized when interaction between the color former and the developer is increased and an erased state is realized when the interaction is decreased. Thus, the inventors have proposed, as effective paper reuse techniques substitutable to the current techniques, image forming materials of a composition system comprising a color former, a developer and an erasing agent. The image forming materials can exhibit stably a colored state around room temperature and can retain an erased state for a long time at practical temperatures by treatment with heat or a solvent. The inventors have also proposed image erasing processes and image erasing apparatuses using the image forming materials.

These image forming materials have advantages of highly stable colored and erased states of the images, highly safety in view of materials, applicability to electrophotography toners, liquid inks, ink ribbons and writing instruments, and feasibility of large-scale erasure treatment, which cannot be realized so far.

The present inventors have further found that cellulose which is a constituent element of "paper" also has the erasing function, and proposed that even an image forming material not containing an erasing agent can be erased by treatment with heat or a solvent in applications of using paper as a recording medium.

For example, JP-A 2000-284520 (KOKAI) discloses that, by using an image forming material containing a color former, a developer and a binder resin, a clear image can be formed and the image can be erased sufficiently. In this image forming material, the equilibrium between the color former and the developer is shifted to the colorless side when the material is heated, and the state shifted to the colorless side can be maintained by the binder resin when the material is cooled, so that the image can be erased.

Examples of the color former (known as a leuco dye) contained in the image forming materials include electron donating organic materials such as leucoauramines, diarylphthalides, polyarylcarbinols, acylauramines, arylauramines, rhodamine B lactams, azaphthalides, spiropyrans, and fluoranes.

Among leuco dyes, crystal violet lactone (CVL) particularly shows an excellent heat erasure performance as compared with other leuco dyes. However, CVL has a problem that it exhibits rather poor color density as compared with other leuco dyes.

BRIEF SUMMARY OF THE INVENTION

An erasable image forming material according to an aspect of the present invention comprises a color former containing crystal violet lactone, a developer, a first binder resin of styrene-butadiene copolymer and a second binder resin of a styrene-based resin containing α-methylstyrene, the first and second binder resins are in a compatible state.

DETAILED DESCRIPTION OF THE INVENTION

Figure 1:
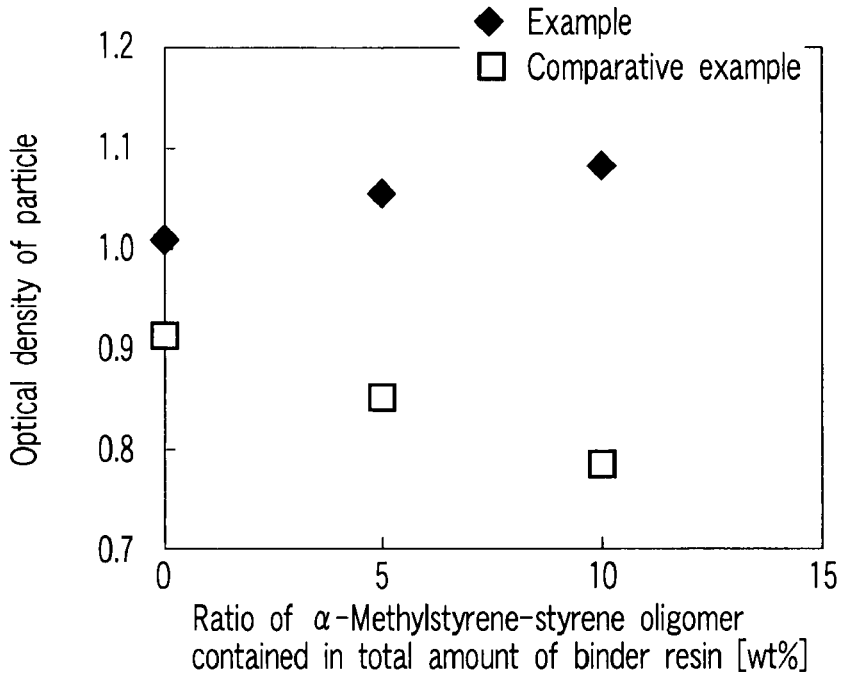
FIG. 1 is a graph showing a relationship between ratio of α-methylstyrene-styrene oligomer contained in total amount of binder resin and optical density of particle in Example 1.

The present invention will be described in detail.

An erasable image forming material according to an embodiment of the present invention comprises a color former containing crystal violet lactone, a developer, a first binder resin of styrene-butadiene copolymer and a second binder resin of a styrene-based resin containing α-methylstyrene, the first and second binder resins being in a compatible state.

In embodiments of the present invention, the color former may contain only crystal violet lactone, but it is preferable that the color former contains a second leuco dye in addition to the crystal violet lactone. A suitable second leuco dye is a fluorine-based leuco dye. Particularly suitable second leuco dye is a black leuco dye represented by 2-anilino-6-(N-alkyl-N-alkylamino)-3-methylfluorane and derivatives thereof.

Examples of the fluorine-based leuco dye include
2-anilino-6-(N,N-diethylamino)-3-methylfluorane,
2-anilino-6-(N,N-dipropylamino)-3-methylfluorane,
2-anilino-6-(N,N-dibutylamino)-3-methylfluorane,
2-anilino-6-(N,N-dipentylamino)-3-methylfluorane,
2-anilino-6-(N,N-dihexylamino)-3-methylfluorane,
2-anilino-6-(N,N-dioctylamino)-3-methylfluorane,
2-anilino-6-(N,N-diisopropylamino)-3-methylfluorane,
2-anilino-6-(N,N-diisobutylamino)-3-methylfluorane,
2-anilino-6-(N,N-diisopentylamino)-3-methylfluorane,
2-anilino-6-(N-methyl-N-ethylamino)-3-methylfluorane,
2-anilino-6-(N-methyl-N-isopropylamino)-3-methylfluorane, 2-anilino-6-(N-methyl-N-isobutylamino)-3-methylfluorane, 2-anilino-6-(N-methyl-N-isopentylamino)-3-methylfluorane,
2-anilino-6-(N-methyl-N-propylamino)-3-methylfluorane,
2-anilino-6-(N-methyl-N-butylamino)-3-methylfluorane,
2-anilino-6-(N-methyl-N-pentylamino)-3-methylfluorane,
2-anilino-6-(N-methyl-N-hexylamino)-3-methylfluorane,
2-anilino-6-(N-methyl-N-octylamino)-3-methylfluorane,
2-anilino-6-(N-ethyl-N-propylamino)-3-methylfluorane,
2-anilino-6-(N-ethyl-N-isobutylamino)-3-methylfluorane,
2-anilino-6-(N-ethyl-N-isopentylamino)-3-methylfluorane, 2-anilino-6-(N-ethyl-N-2-methylbutylamino)-3-methylfluorane, 2-anilino-6-(N-ethyl-N-2-ethylpropylamino)-3-methylfluorane, and
2-anilino-6-(N-ethyl-N-hexylamino)-3-methylfluorane.

Examples of the developer includes phenols, metal phenolates, carboxylic acids, metal carboxylates, benzophenones, sulfonic acids, metal sulfonates, phosphoric acids, metal phosphates, acidic phosphoric esters, acidic phosphoric ester metal salts, phosphorous acids, and metal phosphites. These developers can be used alone or in a combination of two or more species. In particular, examples of preferable developer include: gallic acid; gallate such as methyl gallate, ethyl gallate, n-propyl gallate, i-propyl gallate, and i-butyl gallate; dihydroxybenzoic acid and its ester such as 2,3-dihydroxybenzoic acid, and methyl 3,5-dihydroxybenzoate; hydroxyacetophenones such as 2,4-dihydroxyacetophenone, 2,5-dihydroxyacetophenone, 2,6-dihydroxyacetophenone, 3,5-dihydroxyacetophenone, and 2,3,4-trihydroxyacetophenone; hydroxybenzophenones such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, and 2,3,4,4'-tetrahydroxybenzophenone; biphenols such as 2,4'-biphenol, and 4,4'-biphenol; and polyhydric phenols such as 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4'-(ethylidene)trisphenol, 4,4'-(1-methylethylidene)bisphenol, and methylenetris-p-cresol. Examples of the most preferable developer include: gallate such as methyl gallate, ethyl gallate, n-propyl gallate, i-propyl gallate, and butyl gallate; and hydroxybenzophenones such as 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, and 2,3,4,4'-tetrahydroxybenzophenone.

The present inventors have hound that, if a binder resin used contains a first binder resin of styrene-butadiene copolymer and a second binder resin of a styrene-based resin containing α-methylstyrene which are in a compatible state, an erasable image forming material showing an excellent color density can be provided without lowering heat erasure performance. In the embodiments of the present invention, the first binder resin and the second binder resin are made compatible with each other by kneading the components of the image forming material at a temperature above the softening point of the second binder resin. When the components of the image forming material are kneaded at a temperature below 130° C., at least a part of the first binder resin and the second binder resin is made to be in a phase-separated state.

The styrene-butadiene copolymer constituting the first binder resin preferably has a butadiene ratio of 5 to 15 wt %.

Examples of the styrene-based resin containing α-methylstyrene constituting the second binder resin include: α-methylstyrene resin, α-methylstyrene-styrene copolymer, α-methylstyrene-aliphatic copolymer, α-methylstyrene-alicyclic copolymer, α-methylstyrene-styrene-aliphatic terpolymer, α-methylstyrene-styrene-alicyclic copolymer. Among them, α-methylstyrene resin and α-methylstyrene-styrene copolymer are suitable.

The ratio of second binder resin contained in the total amount of binder resin is preferably 5 wt % or more and 50 wt % or less, and more preferably 10 wt % or more and 20 wt % or less. If the ratio of second binder resin contained in the total amount of binder resin is less than 5 wt % or greater than 50 wt %, the effect of improving the color density cannot be provided.

It should be noted that the effect of improving the color density without lowering the heat erasure performance by use of the binder resin in which the first binder resin and the second binder resin are made compatible with each other can be provided only when the suitable color formed containing CVL. For example, even if the above binder resin in which the first binder resin and the second binder resin are made compatible with each other is used with an azaphthalide-based leuco dye represented by 3-(4-diethylamino-2-ethoxyphenyl)-3-(1-ethyl-2-methylindol-3-yl)-4-azaphthalide, the effect of improving the color density cannot be observed.

When the erasable image forming material according to an embodiment of the present invention is used as a toner, thermal properties of the binder resin are represented by the values of a softening point and a glass transition point, where the softening point preferably ranges from 110 to 150° C. and the glass transition point preferably ranges from 55 to 85° C. For example, the softening temperature can be determined as a temperature ($T_{1/2}$) at the time when the flow-out amount of a sample reaches the half value of the sample amount using a flow tester (for example, CFT-500 manufactured by Shimadzu Corp) under the conditions that the nozzle size is 1.0 mmφ×10.0 mm, the load is 30 kgf, the temperature rise is 3° C./min, and the sample amount is 1.0 g. The glass transition point can be determined as a temperature calculated as a shoulder value after melt-quench with a differential scanning calorimeter (DSC). The shoulder value is referred to as "an intermediate point between a start point and an end point of specific heat change" in a vicinity of an inflection point of change in specific heat.

A charge control agent may be used to adjust charging characteristics of the toner. Since the erasable image forming material according to an embodiment of the present invention is required not to leave a color when erased, the charge control agent is preferred to be colorless or transparent. Examples of a negative charge control agent include E-89 (calixarene derivative) available from Orient Kagaku K.K., N−1, N−2, N−3 (all are phenol-based compounds) and LR147 (boron-based compound) available from Japan Carlit Co., Ltd., and FCA-1001N (styrene-sulfonic acid-based resin) available from FUJIKURA KASEI CO. LTD. In particular, E-89 and LR147 are preferred. Examples of a positive charge control agent include TP-302 (CAS #116810-46-9) and TP-415 (CAS #17324-25-2) available from Hodogaya Chemical Co., Ltd., P-51 (quaternary amine compound) and AFP-B (polyamine oligomer) available from Orient Kagaku K.K., and FCA-201PB (styrene-acrylic quaternary ammonium salt resin) available from FUJIKURA KASEI CO. LTD.

A wax may be added to control a fixing property. The wax to be added to the image forming material according to an embodiment of the present invention is preferably formed of a component not developing the color former. Examples of the wax include higher alcohol, higher ketone, and higher aliphatic ester, whose acid value is preferably 10 mg KOH/g or less. The wax preferably has a weight-average molecular weight of $10^2$ to $10^5$, more preferably $10^2$ to $10^4$. As long as the weight-average molecular weight is within the above range, low molecular-weight polypropylene, low molecular-weight polyethylene, low molecular-weight polybutylene, and low molecular-weight polyalkane may be used as the wax. The addition amount of the wax is preferably 0.1 to 30 parts by weight, more preferably 0.5 to 15 parts by weight.

In the image forming material according to an embodiment of the present invention, external additives may be added, if required, to control flowability, shelf life, anti-blocking property, and grinding property for photosensitive body. Examples of the external additives include silica fine particles, metal oxide fine particles, and cleaning auxiliary. Examples of the silica fine particles include silicon dioxide, sodium silicate, zinc silicate, and magnesium silicate. Examples of the metal oxide fine particles include zinc oxide, magnesium oxide, zirconium oxide, strontium titanate, and barium titanate. Examples of the cleaning auxiliary include resin fine powder such as polymethyl methacrylate, polyvinylidene fluoride, and polytetrafluoroethylene. These external additives may be subjected to surface treatment for hydrophobing. External additives used for toner are usually subjected to hydrophobing treatment. In the case of negative charging, a hydrophobing agent such as a silane coupling agent, a titanium coupling agent and silicone oil may be used. In the case of positive charging, a hydrophobing agent such as an aminosilane-based hydrophobing agent and silicone oil having amine in the side chains thereof may be used. The addition amount of the external additive is preferably 0.05 to 5 parts by weight, and more preferably 0.1 to 3.0 parts by weight to 100 parts by weight of toner. Silica particles used for toner generally has a mean particle size (as a primary particle) of 10 to 20 nm. Silica particles with mean particle size of about 100 nm may also be used. As to other material than silica, relatively large particles with a mean particle size of 0.05 to 3 μm are generally used.

Methods of mixing and dispersing the color former and developer in the binder resin includes a method in which the materials are dispersed in wet process using a solvent with a high-speed dissolver, a roll mill or a ball mill; or a method in which the materials are melted and kneaded with a roll, a pressurizing kneader, an internal mixer or a screw extruder. Examples of the mixer include a ball mill, a V-mixer, a Vorberg mixer, and a Henschel mixer.

Incidentally, it has been confirmed that the erasable image forming materials according to embodiments of the present invention have side effects of controlling "adhesion" and improving storage stability. The "adhesion" means a problem that paper sheets are adhered with each other when printed paper sheets are subjected to batch-wise heat erasure in a form of a bundle. This phenomenon which is specific to a batch type erasing apparatus becomes an obstacle for the reuse of paper. It is understood that the "adhesion" is caused such that the softened binder resin in the image forming material is adhered to the back surface of the overlaid paper sheet. In order to lower the "adhesion", a large amount of releasing agent (such as polypropylene wax) that is more than two times that in a common toner is used in the conventional erasable image forming materials. Also, the occurrence of "adhesion" is suppressed by decreasing the transfer amount of the material in printing and reducing the application area. In contrast, in order to suppress the occurrence of "adhesion" more efficiently, it is preferable to improve fracture characteristics of the binder resin after it is hardened. In other words, it is preferable to impart brittleness to the binder resin so that it can be easily peeled off. Since the styrene-based resin containing α-methylstyrene, the second binder resin, can be compatible with the styrene-butadiene copolymer, the first binder resin, and also shows high cohesive force, it is probably effective to suppress the occurrence of adhesion. However, the softening point of the resin is preferably in the range of heat erasure temperature (120 to 140° C.) so that the wax component is successfully bled to the surface of the toner.

When the temperature of the toner is raised during storage, softening components may be exuded from the binder resin of the toner, which may cause a phenomenon that toner particles are adhered with each other. Thus, the storage temperature is important for the storage stability of the toner. The threshold value of the storage temperature can be raised some degree by externally adding a filler, but it is basically around the glass transition point (Tg). The glass transition point of the binder resin can be improved through polymer alloying. For example, if a styrene-butadiene copolymer having a glass transition temperature of 63.5° C. (the central value in DSC measurement) is used as a base polymer and an α-methylstyrene-styrene oligomer is made compatible with the former, it is observed that the glass transition point of the toner is raised by about 2.5° C. for the addition amount of the α-methylstyrene-styrene oligomer of 10 wt %, and about 5° C. for 20 wt %. It is confirmed that the storage stability of the toner can be improved as the result of the raise in the glass transition point.

EXAMPLES

Example 1

In this Example, a styrene-butadiene copolymer with 10 wt % of butadiene was used as the first binder resin and an α-methylstyrene-styrene oligomer (Mw of about 3400) having a softening point of 137° C. was used as the second binder resin. Three kinds of binder resins were prepared by blending the first and second binder resins in such a manner that the ratio of second binder resin contained in the total amount of binder resin is set to 0 wt %, 5 wt % or 10 wt %.

Mixed were 3.65 wt % of crystal violet lactone (CVL) and 0.5 wt % of 2-anilino-6-(N-ethyl-N-isopentylamino)-3-methylfluorane (leuco dye S-205 available from Yamada Kagaku Co., Ltd.) as color formers, 2 wt % of ethyl gallate as a developer, 5 wt % of polypropylene wax of a wax component, 1 wt % of charge control agent (LR-147 available from Japan Carlit Co., Ltd.), and 87.85 wt % of binder resin.

The mixture was kneaded with a three roller kneader. The mixture for Example was kneaded under a condition (at 140° C.) that the first and second binder resins were made a compatible state, while the mixture for Comparative Example was kneaded under a condition (at 120° C.) that the first and second binder resins were made a phase-separated state. The kneaded product was ground with a grinder into powder with an average particle size of 11.3 μm to prepare a blue toner for electrophotography. Then, one part by weight of hydrophobic silica was added to 100 parts by weight of the resultant powder to prepare a sample. In such a manner, three kinds of samples were prepared for each of Example and Comparative Example, respectively.

The optical density of particle before adding hydrophobic silica was measured. Specifically, power before addition of hydrophobic silica was put in a powder cell and then the color density of the powder was measured with a calorimeter (CR300 manufactured by Minolta).

FIG. 1 is a graph showing a relationship between ratio of α-methylstyrene-styrene oligomer contained in total amount of binder resin and optical density of particle. In the Example toners which were prepared under the compatible condition, the optical density of particle was raised with the increase in the ratio of α-methylstyrene-styrene oligomer. On the other hand, in the Comparative Example toners which were prepared under the phase-separation condition, the optical density of particle was lowered with the increase in the ratio of α-methylstyrene-styrene oligomer.

The erasure performance was evaluated using each of the three Example toners. The procedure of the experiment for evaluation and the evaluation method are as follows. Using each of the three toners prepared, square images having sides of 15 mm (hereinafter, referred to as solid patterns) were formed on several types of copy papers in several levels of image density by means of a multi-function printer (Premage 351 of TOSHIBA TEC CORPORATION). These images were used as original images for evaluating the erasure performance. Heat erasure was performed by heating the solid patterns printed on the copy paper at 130° C. for 2 hours in a thermostat.

The erasure performance is evaluated by calculating the erasability. Here, the image density (ID) is the common logarithm of a reciprocal number of reflectance of the image, and the image density (ID) of paper is the common logarithm of a reciprocal number of reflectance of the paper itself. First, reflectance values of the original images for evaluation which are printed on each copy paper are measured to calculate the original image density. Similarly, reflectance values of images after erasure (residual images) are measured to calculate the residual image density. The inclination of a regression line is calculated by plotting a value obtained by subtracting the paper ID from the original ID before heat erasure, [(original ID−paper ID)], on the abscissa and a value obtained by subtracting the paper ID from the residual ID after heat erasure, [(residual ID−paper ID)], on the ordinate for every paper for evaluation. The arithmetic mean of the inclinations of regression line of every paper thus obtained is calculated as an erasability. The erasability represents an approximate ratio of the residual ID to the original ID, which implies that the smaller the value, the higher the heat erasure performance. For example, if the original ID is 1.0, the erasability of 0.05 means that the residual ID remaining after heat erasure is 0.05.

Figure 2:
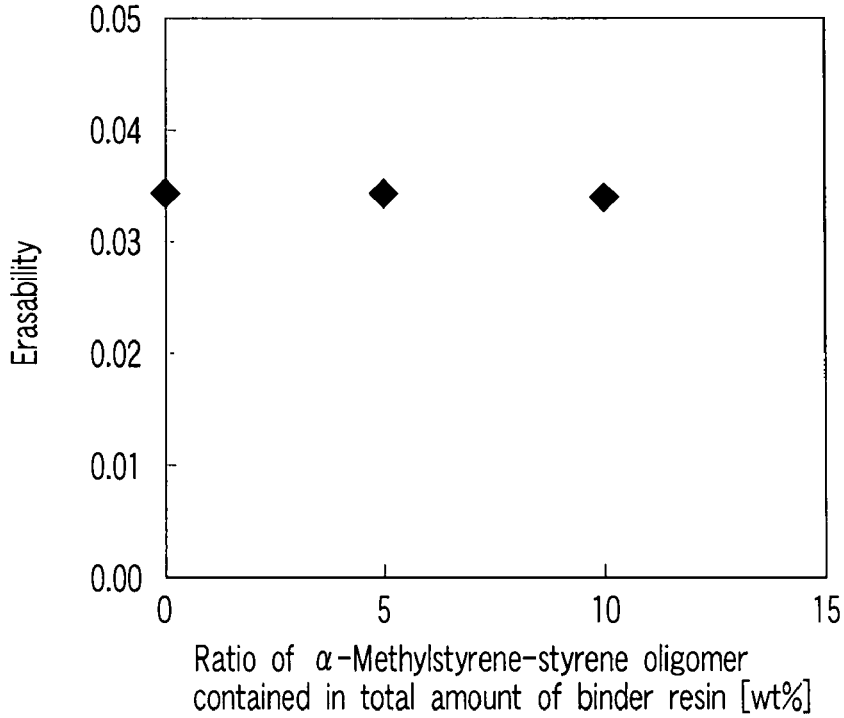
FIG. 2 is a graph showing a relationship between ratio of α-methylstyrene-styrene oligomer contained in total amount of binder resin and erasability in Example 1.

FIG. 2 is a graph showing a relationship between ratio of α-methylstyrene-styrene oligomer contained in total amount of binder resin and erasability. It is found from FIG. 2 that the erasabilitys are kept at an approximately constant value irrespective of the ratio of α-methylstyrene-styrene oligomer contained in the total amount of binder resin.

It is found form FIGS. 1 and 2 that, if a binder containing a first binder resin of styrene-butadiene copolymer and a second binder resin of a styrene-based resin containing α-methylstyrene is used for an erasable image forming material, the color density can be improved with the heat erasure performance maintained.

Example 2

In this Example, a styrene-butadiene copolymer with 10 wt % of butadiene was used as the first binder resin and an α-methylstyrene oligomer (Mw of about 2700) having a softening point of 138° C. was used as the second binder resin. Four kinds of binder resins were prepared by blending the first and second binder resins in such a manner that the ratio of second binder resin contained in the total amount of binder resin is set to 0 wt %, 5 wt %, 10 wt % or 20 wt %.

Mixed were 3.65 wt % of crystal violet lactone (CVL) and 0.5 wt % of 2-anilino-6-(N-ethyl-N-isopentylamino)-3-methylfluorane (leuco dye S-205 available from Yamada Kagaku Co., Ltd.) as color formers, 2 wt % of ethyl gallate as a developer, 5 wt % of polypropylene wax of a wax component, 1 wt % of charge control agent (LR-147 available from Japan Carlit Co., Ltd.), and 87.85 wt % of binder resin.

The mixture was stirred with a Henschel mixer, and the mixture was kneaded with a Banbury-type kneader. The mixture was kneaded under a condition (at 140° C.) that the first and second binder resins were made a compatible state. The kneaded product was ground with a grinder into powder with an average particle size of 11.3 μm to prepare a blue toner for electrophotography. Then, one part by weight of hydrophobic silica was added to 100 parts by weight of the resultant powder to prepare a sample. In such a manner, four kinds of samples were prepared.

Figure 3:
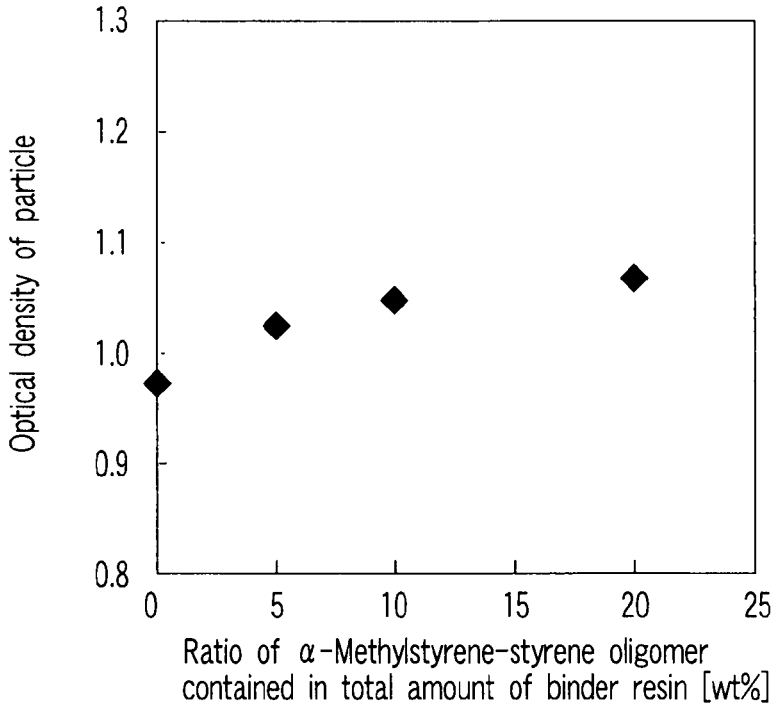
FIG. 3 is a graph showing a relationship between ratio of α-methylstyrene-styrene oligomer contained in total amount of binder resin and optical density of particle in Example 2.

With respect to these toners, the optical density of particle and the heat erasure performance were evaluated in the same manner as in Example 1. FIG. 3 is a graph showing a relationship between ratio of α-methylstyrene oligomer contained in total amount of binder resin and optical density of particle, and FIG. 4 is a graph showing a relationship between a ratio of α-methylstyrene oligomer contained in the total amount of binder resin and erasability.

Figure 4:
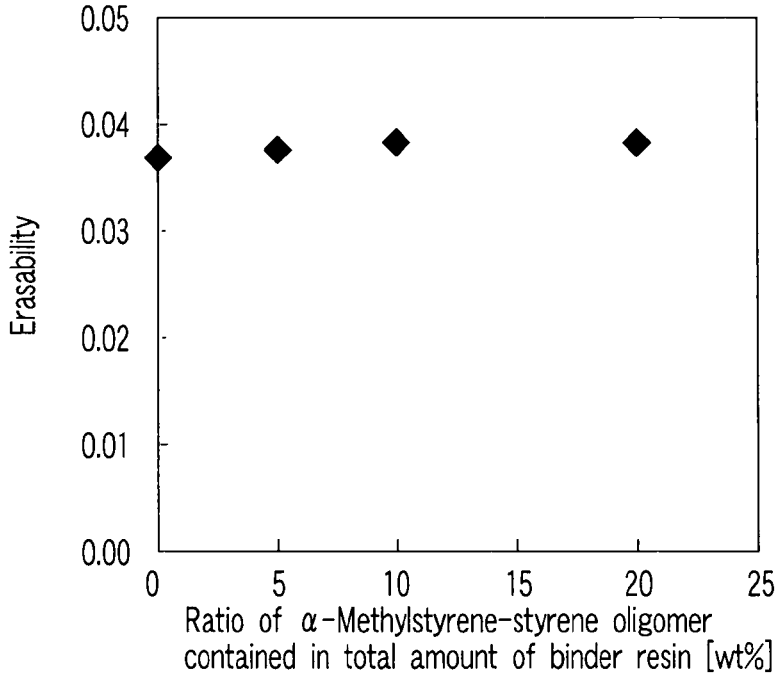
FIG. 4 is a graph showing a relationship between ratio of α-methylstyrene-styrene oligomer contained in total amount of binder resin and erasability in Example 2.

It is found form FIGS. 3 and 4 that, if a binder containing a first binder resin of styrene-butadiene copolymer and a second binder resin of a styrene-based resin containing α-methylstyrene is used for an erasable image forming material, the color density can be improved with the heat erasure performance maintained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing an erasable image forming material comprising a color former comprising crystal violet lactone, a developer, a first binder resin of a styrene-butadiene copolymer and a second binder resin of a styrene-based resin comprising α-methylstyrene, wherein the method comprises:

kneading the color former, the developer, the first binder resin and the second binder resin at a temperature above a softening point of the second binder resin to make the first and second binder resins in a compatible state.

2. The method according to claim 1, wherein the color former further comprises 2-anilino-6-(N-alkyl-N-alkylamino)-3-methylfluorane.

3. The method according to claim 1, wherein a ratio of second binder resin contained in a total amount of binder resin is 5 wt. % or more and 50 wt. % or less.

4. The method according to claim 1, wherein a ratio of second binder resin contained in a total amount of binder resin is 10 wt. % or more and 20 wt. % or less.

5. The method according to claim 1, wherein the styrene-butadiene copolymer contains from 5 wt. % to 15 wt. % of butadiene.

6. The method according to claim 1, wherein the developer is selected from the group consisting of gallates and hydroxy benzophenones.

7. The method according to claim 1, wherein the erasable image forming material further comprises a wax component.

8. The method according to claim 1, wherein the erasable image forming material further comprises a charge control agent.

9. The method according to claim 1, wherein the erasable image forming material further comprises an external additive selected from the group consisting of a silica fine particle, a metal oxide fine particle, and a cleaning auxiliary.

10. The method according to claim 1, wherein the color former further comprises a second leuco dye in addition to the crystal violet lactone.

11. The method according to claim 1, wherein the styrene-based resin comprising α-methylstyrene is selected from the group consisting of α-methylstyrene resin α-methylstyrene-styrene copolymer, α-methylstyrene-aliphatic copolymer, α-methylstyrene-alicyclic copolymer, α-methylstyrene-styrene-aliphatic terpolymer, and α-methylstyrene-styrene-alicyclic copolymer.

12. The method according to claim 1, wherein the styrene-based resin comprising α-methylstyrene is α-methylstyrene.

13. The method according to claim 1, wherein the styrene-based resin comprising α-methylstyrene is α-methylstyrene-styrene copolymer.

14. The method according to claim 1, wherein a ratio of second binder resin contained in a total amount of binder resin is 10 wt. % or more and 20 wt. % or less, wherein the styrene-based resin comprising α-methylstyrene is selected from the group consisting of α-methylstyrene resin, α-methylstyrene-styrene copolymer, α-methylstyrene-aliphatic copolymer, α-methylstyrene-alicyclic copolymer, α-methylstyrene-styrene-aliphatic terpolymer, and α-methy1styrene-styrene-alicyclic copolymer, and wherein the styrene-butadiene copolymer contains from 5 wt. % to 15 wt. % of butadiene.

* * * * *